US007226188B2

(12) United States Patent
Hough

(10) Patent No.: US 7,226,188 B2
(45) Date of Patent: Jun. 5, 2007

(54) STAGE LIGHTING METHODS AND APPARATUS

(75) Inventor: Thomas A. Hough, Tucson, AZ (US)

(73) Assignee: Whiterock Design, LLC, Tucson, AZ (US)

( * ) Notice: Subject to any disclaimer, the term of this patent is extended or adjusted under 35 U.S.C. 154(b) by 84 days.

(21) Appl. No.: 10/992,802

(22) Filed: Nov. 19, 2004

(65) Prior Publication Data

US 2006/0007686 A1 Jan. 12, 2006

(51) Int. Cl.
*F21S 8/00* (2006.01)

(52) U.S. Cl. ..... 362/268

(58) Field of Classification Search ..... 362/268
See application file for complete search history.

(56) References Cited

U.S. PATENT DOCUMENTS

| | | | |
|---|---|---|---|
| 3,069,536 | A | 12/1962 | Dion et al. |
| 3,933,408 | A | 1/1976 | Reinert |
| 4,146,310 | A | 3/1979 | Kohayakawa et al. |
| 4,392,187 | A | 7/1983 | Bornhorst |
| 4,511,223 | A | 4/1985 | Hirose |
| 4,602,321 | A | 7/1986 | Bornhorst |
| 4,745,531 | A | 5/1988 | Leclercq |
| 4,800,474 | A | 1/1989 | Bornhorst |
| 4,811,182 | A | 3/1989 | Solomon |
| 4,890,208 | A | 12/1989 | Izenour |
| 4,893,225 | A | 1/1990 | Solomon |
| 4,894,760 | A | 1/1990 | Callahan |
| 4,897,770 | A | 1/1990 | Solomon |
| 4,914,556 | A | 4/1990 | Richardson |
| 4,958,265 | A | 9/1990 | Solomon |
| 4,972,306 | A | 11/1990 | Bornhorst |
| 4,984,143 | A | 1/1991 | Richardson |
| 5,073,847 | A | 12/1991 | Bornhorst |
| 5,126,886 | A | 6/1992 | Richardson et al. |
| 5,186,536 | A | 2/1993 | Bornhorst et al. |
| 5,188,452 | A | 2/1993 | Ryan |
| 5,282,121 | A | 1/1994 | Bornhorst et al. |
| 5,416,681 | A | 5/1995 | Wu |
| 5,426,576 | A | 6/1995 | Hewlett |
| 5,497,234 | A | 3/1996 | Haga |
| 5,515,254 | A | 5/1996 | Smith et al. |
| 5,597,223 | A | 1/1997 | Watanabe et al. |

(Continued)

FOREIGN PATENT DOCUMENTS

| | | | |
|---|---|---|---|
| DE | 197 22 191 | A1 | 12/1998 |

(Continued)

*Primary Examiner*—Sandra O'Shea
*Assistant Examiner*—Zahra I. Bennett

(57) ABSTRACT

Spot illumination apparatus and methods are described. According to one implementation a spot luminaire includes a light source for emitting a beam of light and a projection lens configured to project the beam of light towards a distant target. A first field stop, through which the beam of light passes, is positioned between the light source and the projection lens. A filter apparatus is positioned proximate the first field stop and is adapted for selectively moving at least one variable density filter across the beam of light. A relay lens group is positioned between the first field stop and the projection lens. The relay lens group is configured to prevent the at least one variable density filter from being imaged by the projection lens. Methods for providing stage lighting are also described.

28 Claims, 12 Drawing Sheets

U.S. PATENT DOCUMENTS

| | | | | |
|---|---|---|---|---|
| 5,622,418 | A | 4/1997 | Daijogo et al. | |
| 5,622,426 | A | 4/1997 | Romano et al. | |
| 5,659,429 | A | 8/1997 | Kudo | |
| 5,790,329 | A | 8/1998 | Klaus et al. | |
| 6,155,698 | A * | 12/2000 | Yoon et al. | 362/268 |
| 6,198,576 | B1 | 3/2001 | Matsuyama | |
| 6,578,987 | B1 * | 6/2003 | Hough et al. | 362/293 |
| 6,607,280 | B2 * | 8/2003 | Koyama et al. | 362/601 |
| 6,796,682 | B2 | 9/2004 | Hough et al. | |
| 6,796,683 | B2 | 9/2004 | Wood et al. | |
| 7,004,604 | B2 * | 2/2006 | Ohmae et al. | 362/268 |

FOREIGN PATENT DOCUMENTS

| | | |
|---|---|---|
| FR | 2 582 779 A1 | 12/1986 |
| FR | 2 667 954 A1 | 4/1992 |
| GB | 2 239 938 A | 7/1991 |

* cited by examiner

STAGE LIGHTING METHODS AND APPARATUS

TECHNICAL FIELD

The present invention relates generally to spot luminaries having associated color-changing mechanisms and more particularly to spot luminaires which include movable variable density filters configured to selectively control the color and intensity of a projected beam of light.

BACKGROUND

Spot luminaries, such as stage lighting instruments, night-club lighting instruments and the like having motorized subsystems operated by remote-control means are commonly referred to as "moving lights" or "automated luminaires." Among these are two general varieties: spot luminaires and wash luminaires. Spot luminaires are similar to the "profile spot" or ellipsoidal reflector spotlight commonly used in theaters, and provide a hard-edged beam of light. This kind of spotlight has a gate aperture at which various devices can be placed to define the shape or profile of the light beam and has a projection optical system including one or more objective lens elements. A spot luminaire projects an image of the brightly-illuminated gate aperture, including whatever light-shaping, pattern-generating, or image-forming devices might be placed there. Wash luminaires are similar to the "Fresnel Spot" luminaire, which provides a soft-edged, ill-defined beam that can be varied in size by moving the lamp and reflector towards or away from the lens. This kind of wash light has no gate aperture and projects no image, but projects only a soft-edged pool of light shaped by whatever lens or lenses are mounted over the exit aperture of the luminaire.

The development of a spot luminaire having a fully cross-fadeable color mixing system and that is capable of projecting a smooth and uniformly colored beam of light has long been a goal of many lighting manufactures. Although many efforts have been made to develop such luminaires, each of these efforts has failed to achieve the desired goals. A more detailed description of such efforts can be found in U.S. Pat. No. 6,578,987 to Hough et al. which is hereby expressly incorporated by reference.

Typical prior art spot luminaires, and some particular problems associated with them are now discussed with reference to FIGS. 1–6. When referencing the attached figures, like numerals are used to describe like structures when appropriate.

Turning first to FIG. 1, a typical prior art spot luminaire projection optical system is generally indicated by the numeral 10. The optical system 10 includes a lamp 15 and a concave reflector 17. Together the lamp 15 and concave reflector 17 comprise a light source 20. The optical system 10 also includes a field stop/projection gate 25, a light pattern generator 26, and a projection lens 30. The light then exits the projection lens 30 and travels over a distance 32 to a distant projection surface 35. For simplicity, the distant projection surface 35 can be considered to be at least six meters (twenty feet) from the projection lens 30. It should be noted that the outer "zigzag" boundary lines between the reflector and lens of this figure represent "edge rays," which show the outer boundaries of the path of the light from the light source 20 as it travels through the optical system from left to right. This convention applies to all figures incorporated herein. Of course, a single ray of light travels in a straight line unless being reflected or refracting through a lens.

As shown in FIG. 1, the light source 20 can be thought of as illuminating an object 38 (here shown as an up-right arrow) located at the projection gate 25. The object 38 can simply be an aperture formed in the field stop/projection gate 25, or the object 38 can be a light pattern generator 26 which is located at the projection gate 25. An image of the projection gate 25 (or the light pattern generator 26 contained therein) is projected onto the distant projection surface 35. The image of the object 38 is shown by an inverted arrow 40 located on the distant projection surface 35.

The basic optical system which is shown in FIG. 1 will project a polychromatic (white) beam of light. While a white beam of light is useful in many cases, the development of a smooth and uniformly colored beam of light has long been a goal of many lighting manufactures. One of the easiest ways to impart color to a beam of light is through the use of simple absorptive color filters as described below.

Turning now to FIG. 2, the use of absorptive color filters, or "gels", to impart color to a beam of light is described. Here a typical prior art spot luminaire projection optical system is indicated by the numeral 50. The basic structure of the spot luminaire projection optical system 50 is the same as the optical system 10 described above with reference to FIG. 1. However, in addition to the previously described structures, the optical system 50 also includes an absorptive color filter media or gel 55 which is shown to the right of the projection lens 30. Since the gel 55 is larger then the projection lens 30, the light exiting the spot luminaire 50 passes through the gel 55. The result is a uniformly colored image 40 of the projection gate 25 and the light pattern generator 26 contained therein.

Referring now to FIG. 3, the use of dichroic filters to impart color to a beam of light is described. Here a typical prior art spot luminaire projection optical system is indicated by the numeral 60. The basic structure of the spot luminaire projection optical system 60 is the same as the optical system 10 described above with reference to FIG. 1. However, in addition to the previously described structures, the optical system 60 also includes a dichroic filter 65. The dichroic filter 65 is typically positioned near the projection gate 25, and can therefore be much smaller than corresponding gel filters of the same color. Due to their small size, it is possible for a number of dichroic filters 65 to be positioned on a wheel hub and rotated into the beam of light, allowing for rapid color changes. All of the light exiting the spot luminaire 60 passes through the dichroic filter 65, resulting in a uniformly colored image 40 of the projection gate 25 and any light pattern generator 26 contained therein.

Turning now to FIG. 4, a variable density patterned dichroic color filter wheel 70 is described. Variable density patterned dichroic color filter wheels 70 such as this have been employed in some prior art spot luminaire projection optical systems. When a color filter wheel 70 is used, it will typically be positioned between the concave reflector 17 and the projection gate 25 (as shown in FIG. 5). As shown best in FIG. 4, the density of the pattern etched onto the color filter wheel 70 varies radially around the wheel 70. FIG. 4 shows the beam of light 75 passing through the color filter wheel 70 as a circle. When the variable density patterned dichroic color filter wheel 70 is rotated, the saturation level of the beam's color will increase or decrease, depending on the position of the wheel 70 in relation to the beam 75.

As best shown by FIG. 4, the patterned dichroic color filter wheel 70 is patterned with a number of fingers 77. The thickness of each finger 77 varies radially around the wheel 70. The saturation of the color in the projected beam 75 depends on the wheel's location in relation to the beam 75. For example, when the wheel 70 is positioned so that the beam of light 75 passes through the clear portion of the wheel 70 (as shown in FIG. 4) the projected beam will be white.

Turning now to FIG. 5, a prior art spot luminaire projection optical system 80 which incorporates a single patterned dichroic color filter wheel 70 is shown. The basic structure of the spot luminaire projection optical system 80 is similar to the optical system described above with reference to FIG. 1. However, in addition to the previously described structures, the optical system 80 also includes a single patterned dichroic color filter wheel 70. The patterned dichroic filter wheel 70 is positioned near the projection gate 25 to ensure that the wheel 70 is as small as possible. Since the pattern 77 is located adjacent to the light pattern generator 26 and the projection gate 25, the pattern 77 etched onto the color filter wheel 70 is visible in the projected beam of light, and will be imaged on the distant projection surface 35. The visibility and imaging of the pattern 77 is undesirable as the projected beam of light will not be smooth and uniformly colored.

In an attempt to ameliorate this problem, a diffusing optical element 85 (FIG. 6) can be placed in the beam path. The diffusing optical element 85 can be positioned between the patterned color filter media 70 and the projection gate 25. The diffusing optical element 85 serves to blur the image of the pattern 77 etched onto the color filter wheel 70. The effect is similar to viewing a scene through a frosted glass window; the detail (in this case the pattern 77 etched onto the color filter 70) is not discernable.

FIG. 6 shows a prior art spot luminaire projection optical system 90. The basic structure of the spot luminaire projection optical system 90 is similar to that of optical system 10 which was described above with reference to FIG. 1. However, in addition to the previously described structures, the optical system 90 also includes a patterned color and dimming apparatus 95 (consisting of cyan, yellow, and magenta color wheels and a patterned dimmer wheel) and a diffusing optical element 85. Although the beam of light will be uniformly colored, the diffusing optical element 85 will scatter light out of the projection lens system 30. This results in a loss of energy in the projected beam, which is undesirable. The light rays being scattered outside of the projection lens 30 are indicated by the numeral 97.

The present invention was principally motivated by a desire to address the above-identified issues. However, the invention is in no way so limited, and is only to be limited by the accompanying claims as literally worded and appropriately interpreted in accordance with the Doctrine of Equivalents.

SUMMARY OF THE INVENTION

According to one implementation a spot luminaire includes a light source for emitting a beam of light and a projection lens configured to project the beam of light towards a distant target. A first field stop, through which the beam of light passes, is positioned between the light source and the projection lens. A filter apparatus is positioned proximate the first field stop and is adapted for selectively moving at least one variable density filter across the beam of light. A relay lens group is positioned between the first field stop and the projection lens. The relay lens group is configured to prevent the variable density filter from being imaged by the projection lens. In another implementation, the filter apparatus is adapted for selectively rotating a plurality of variable density filters across the beam of light, and the relay lens group positions an image of the filter apparatus so that the image of the filter apparatus is not imaged by the projection lens.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

The readers of this document should understand that the embodiments described herein may rely on terminology used in any section of this document and other terms not readily apparent from the drawings and language common therefore. This document is premised upon using one or more terms with one embodiment that may also apply to other embodiments for similar structures, functions, features and aspects of the invention. Wording used in the claims is also descriptive of the invention and the text of the claims is incorporated by reference into the description entirely in the form of the claims as originally filed. Terminology used with one, some or all embodiments may be used for describing and defining the technology and exclusive rights associated herewith.

The present invention utilizes a patterned color and dimming apparatus, deployed near a small aperture, to uniformly color a projected beam of light. It should be noted, that because the size of the color and dimmer wheels depend on the size of the aperture, it is advantageous that the aperture be as small as possible.

Figure 1:
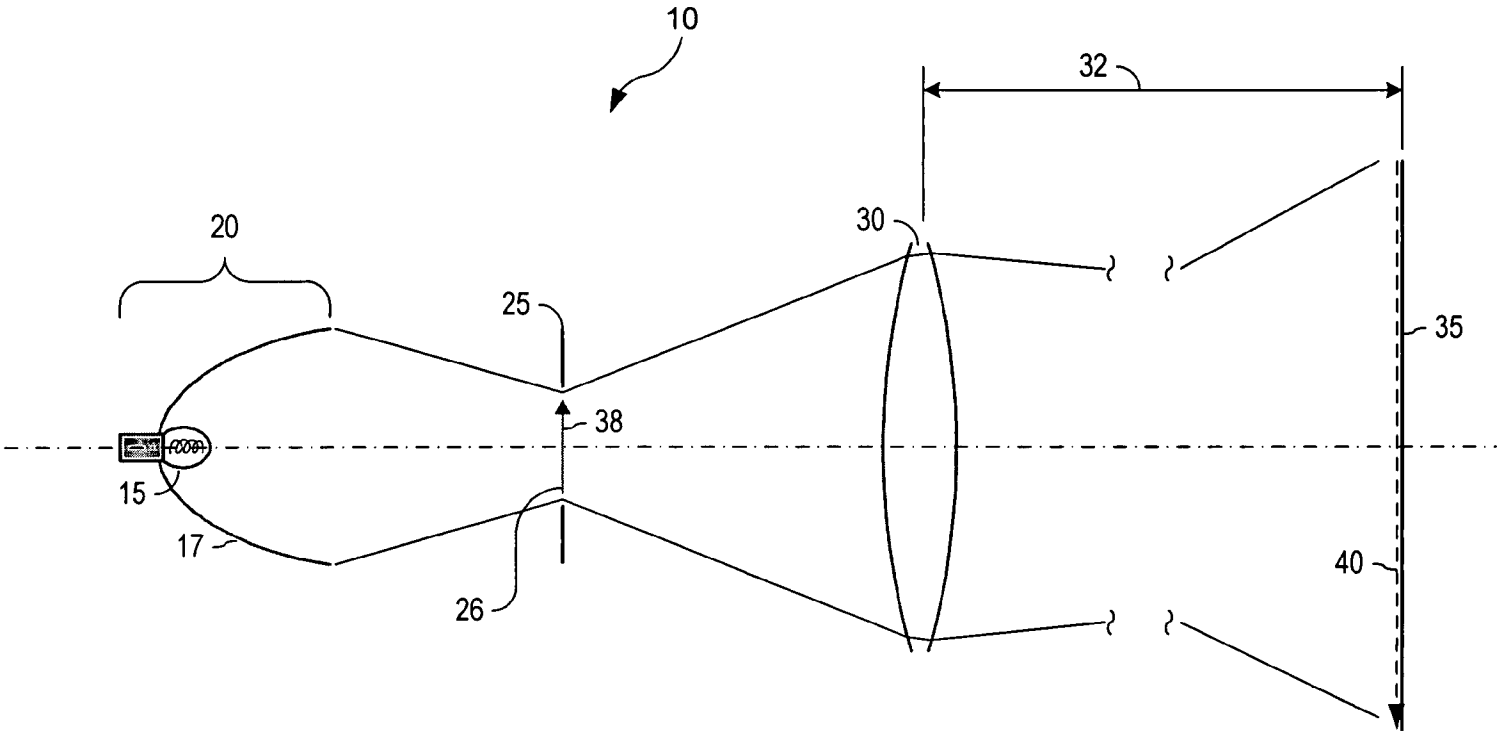
PRIOR ART Fig. 1
FIG. 1 is a schematic diagram of a prior art projection optical system.
Figure 2:
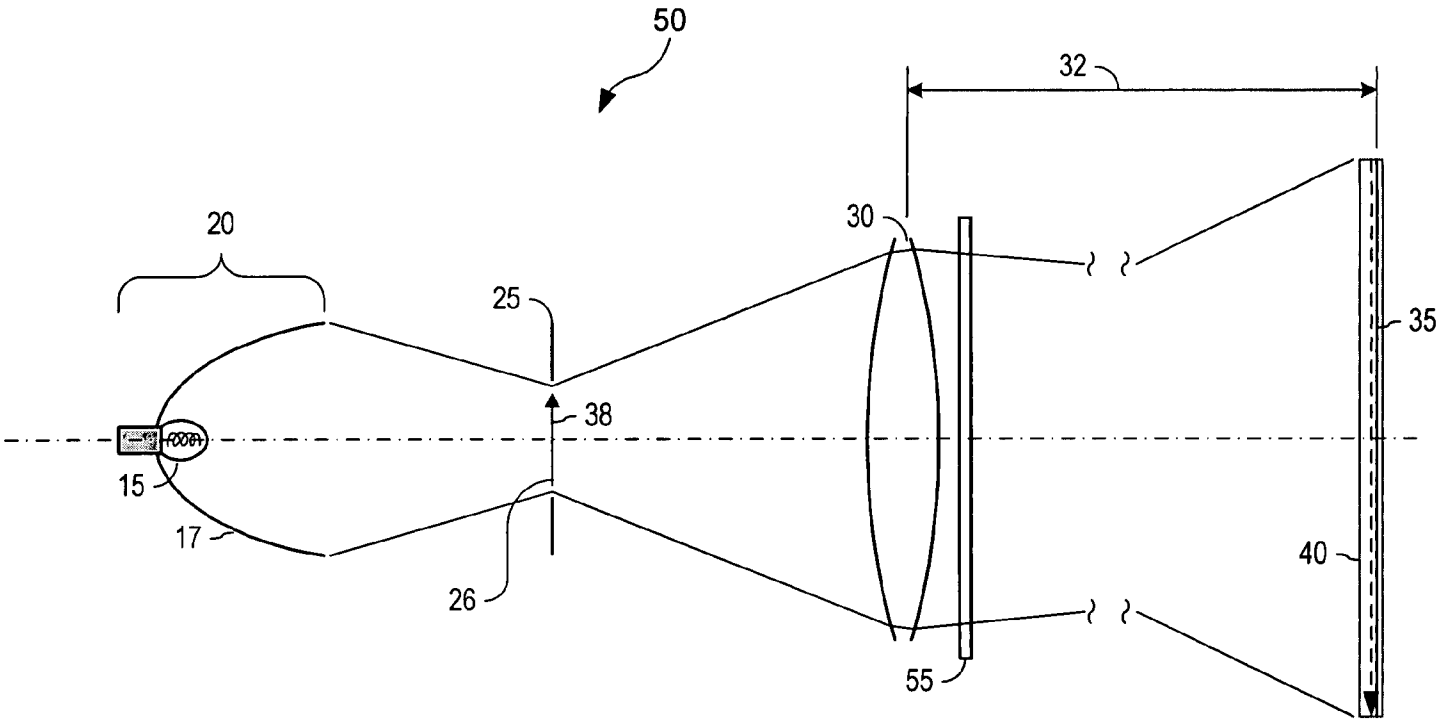
PRIOR ART Fig. 2
FIG. 2 is schematic diagram of a prior art projection optical system including an absorptive color filter.
Figure 3:
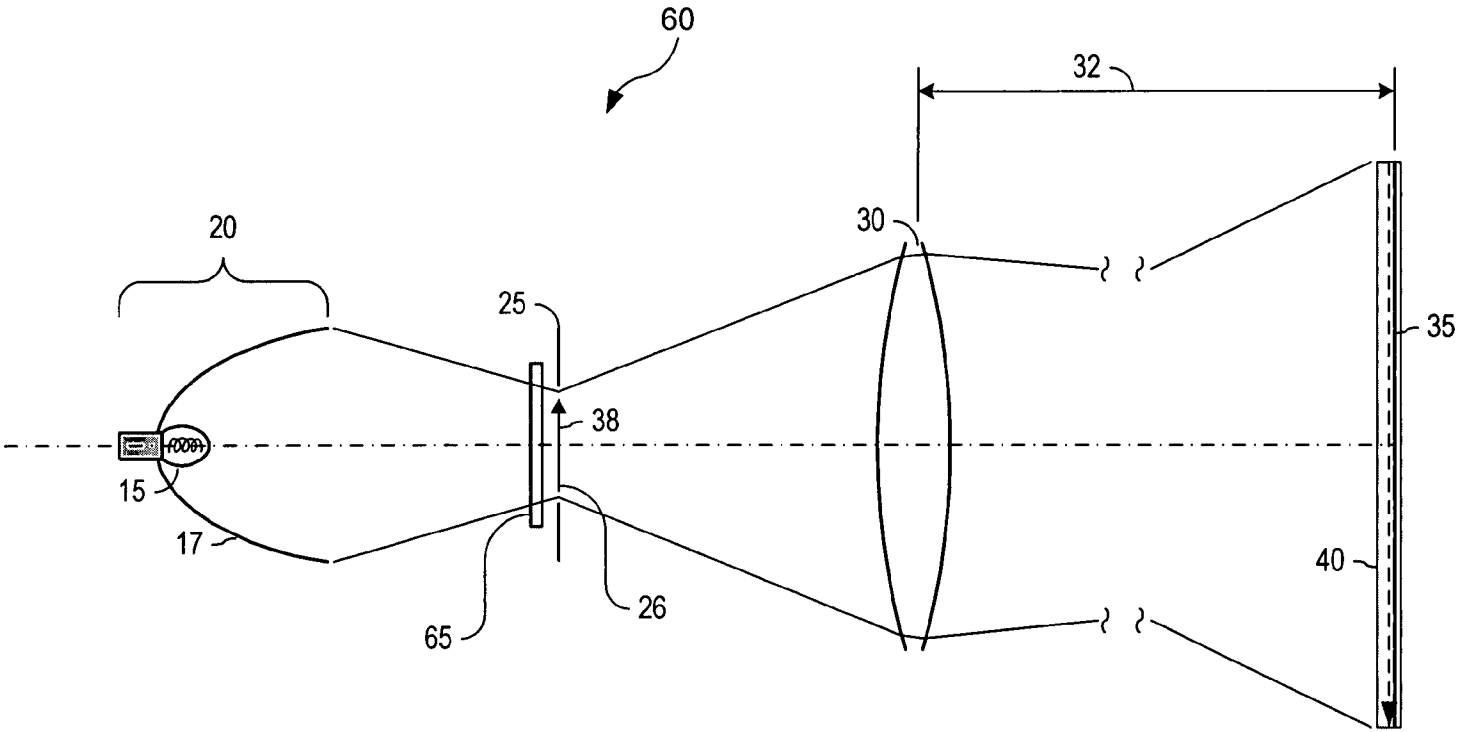
PRIOR ART Fig. 3
FIG. 3 is schematic diagram of a prior art projection optical system containing an unpatterned dichroic color filter.
Figure 4:
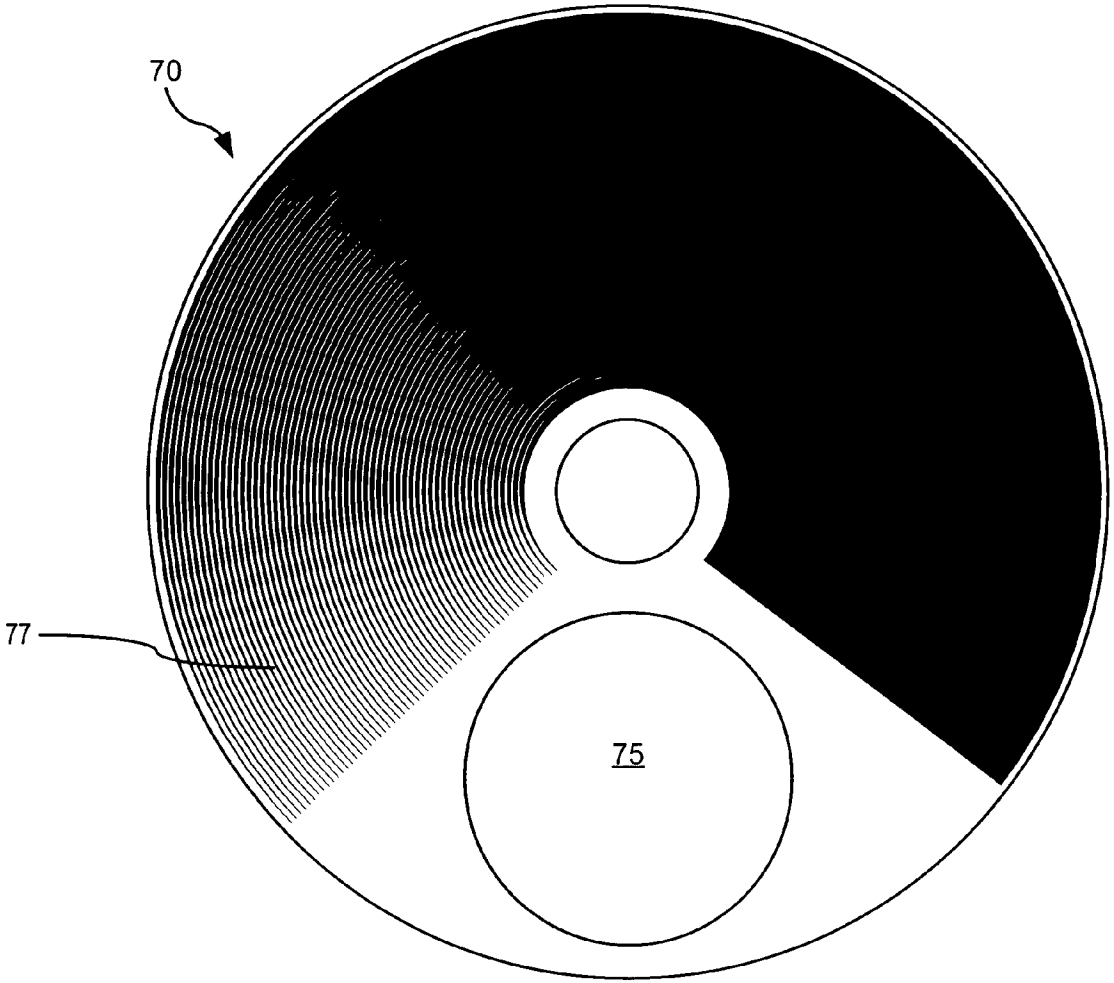
FIG. 4 is a pictorial representation of a patterned dichroic color wheel.
Figure 5:
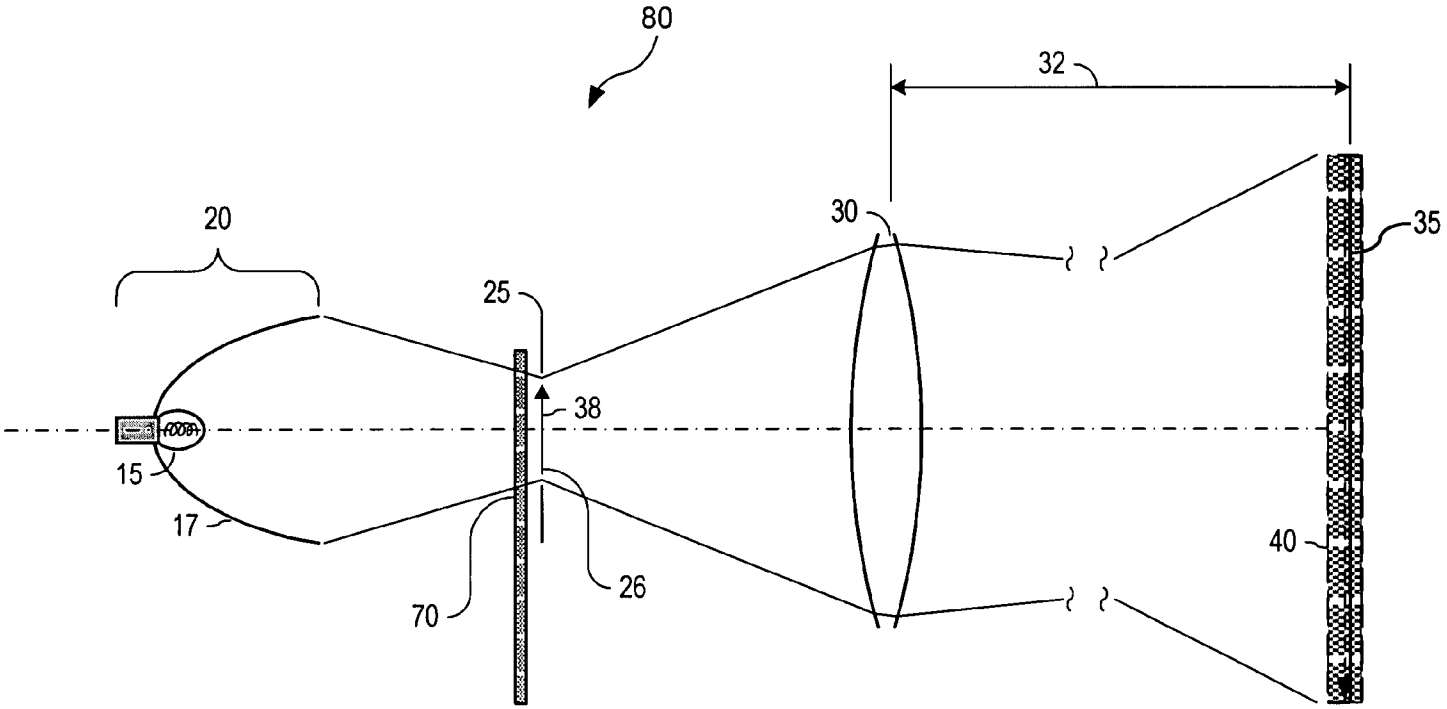
PRIOR ART FIG. 5
FIG. 5 is schematic diagram of a prior art projection optical system including a patterned dichroic color filter.
Figure 6:
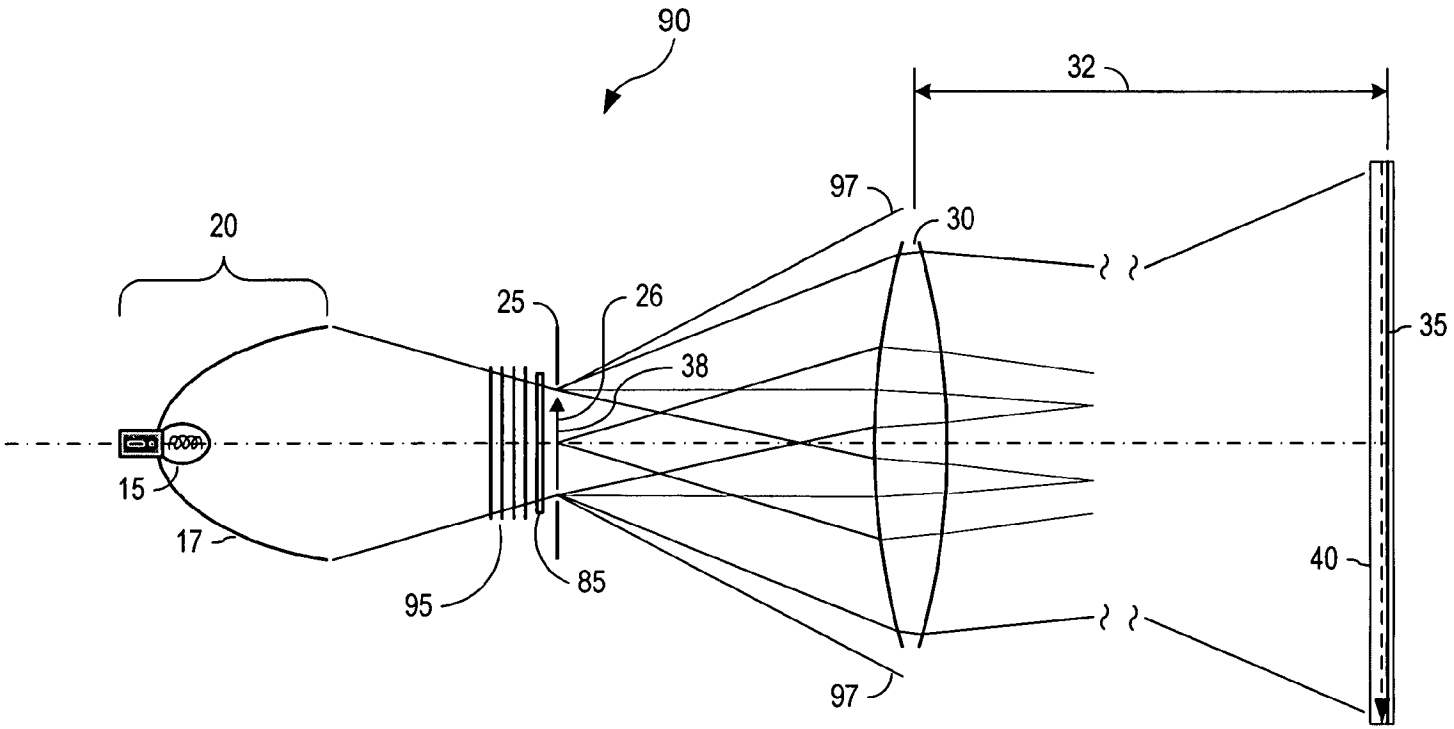
PRIOR ART FIG. 6
FIG. 6 is schematic diagram of a prior art projection optical system including a patterned color filter and dimming apparatus and a diffusing optical element.

To avoid losing energy from the projected beam due to the scattering of light by a diffusing optical element, as was the case with the prior art depicted in FIG. 6 and described above, it is desirable to relocate the real image of the patterned color and dimming wheels to a volume of space that is not imaged by the projection lens. As described below, the addition of a weak negative lens to a relay lens group can serve to relocate the image of the color and dimming system to a volume of space that is not imaged by the projection lens. By "weak" is meant that the absolute value of the negative power of the lens is less than the combined power of the downstream positive lens group. This results in a highly efficient projection system with a uniformly colored projected beam.

Figure 7:
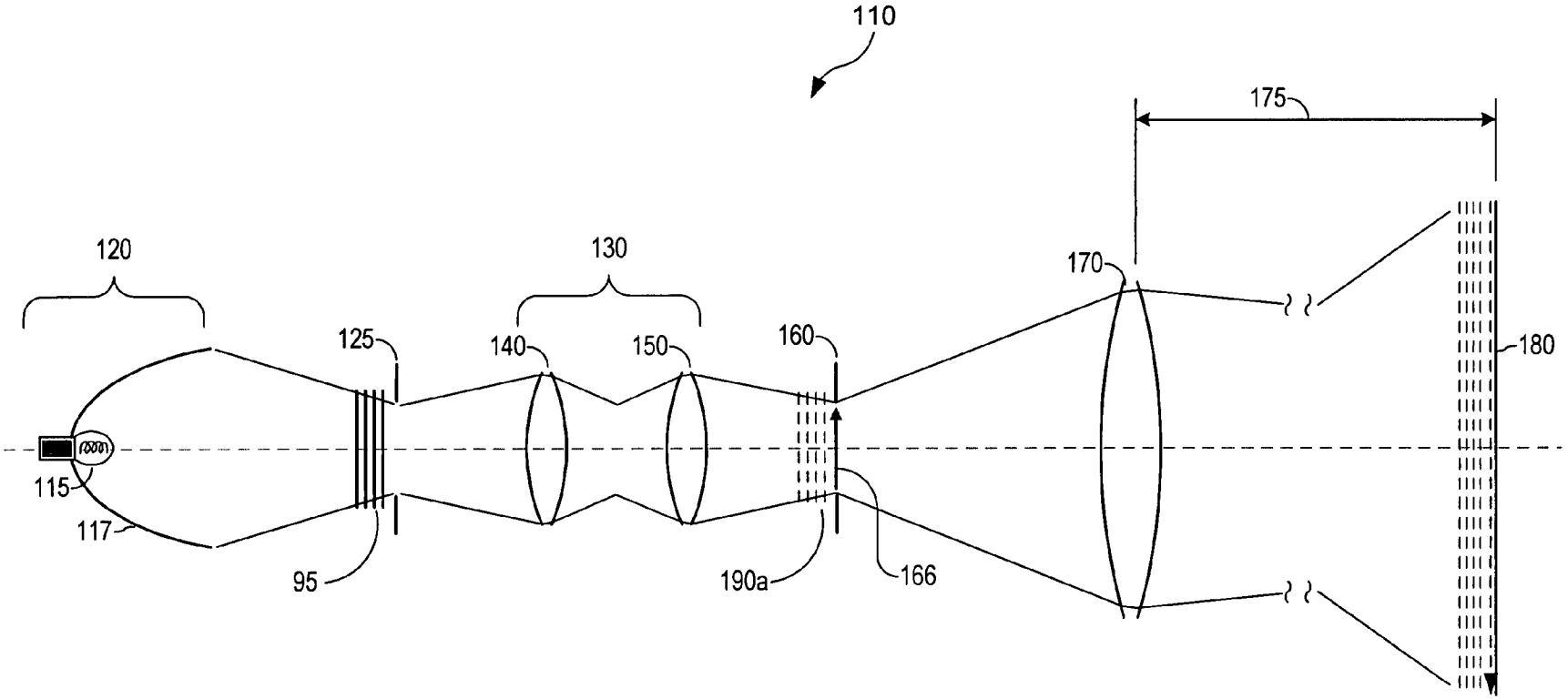
FIG. 7 is schematic diagram of a projection optical system including a patterned color and dimming apparatus and a relay lens system.

Referring now to FIG. 7, this figure shows a spot luminaire projection optical system generally indicated by the numeral 110. The optical system 110 includes a lamp 115 and a concave reflector 117. Together, the lamp 115 and the concave reflector 117 form the light source 120. The optical system 110 also includes a first field stop 125. A patterned color and dimming apparatus 95 is located in a volume contiguous to the first field stop 125. A positive relay lens group 130 is shown to include a first positive lens 140 and a second positive lens 150. The optical system 110 also includes a second field stop 160 which is coincident with the projection gate, a light pattern generator 166, and a projection lens 170. A distance 175 separates the projection lens 170 from a distant projection surface 180. The positive relay lens group 130 relays an image 190*a* of the patterned color and dimming filters 95 and first field stop 125, forming said image 190*a* at a volume contiguous to the second field stop 160. The second field stop 160 is located some distance downstream of the positive relay lens group 130. The second field stop 160 is the same size, and in the same location, as the projection gate. Since the second field stop/projection gate 160 are coincident, the real images 190*a* of the patterned color and dimming wheels 95 act as objects for the projection lens 170. Therefore, the projected beam not only contains an image of the projection gate 160 and the pattern generator 166, but also contains an image of the patterned color and dimmer wheels 190*a*. It would, however, be preferable to not have the image of the patterned color and dimming filters 95 formed at the projection surface 180.

Figure 8:
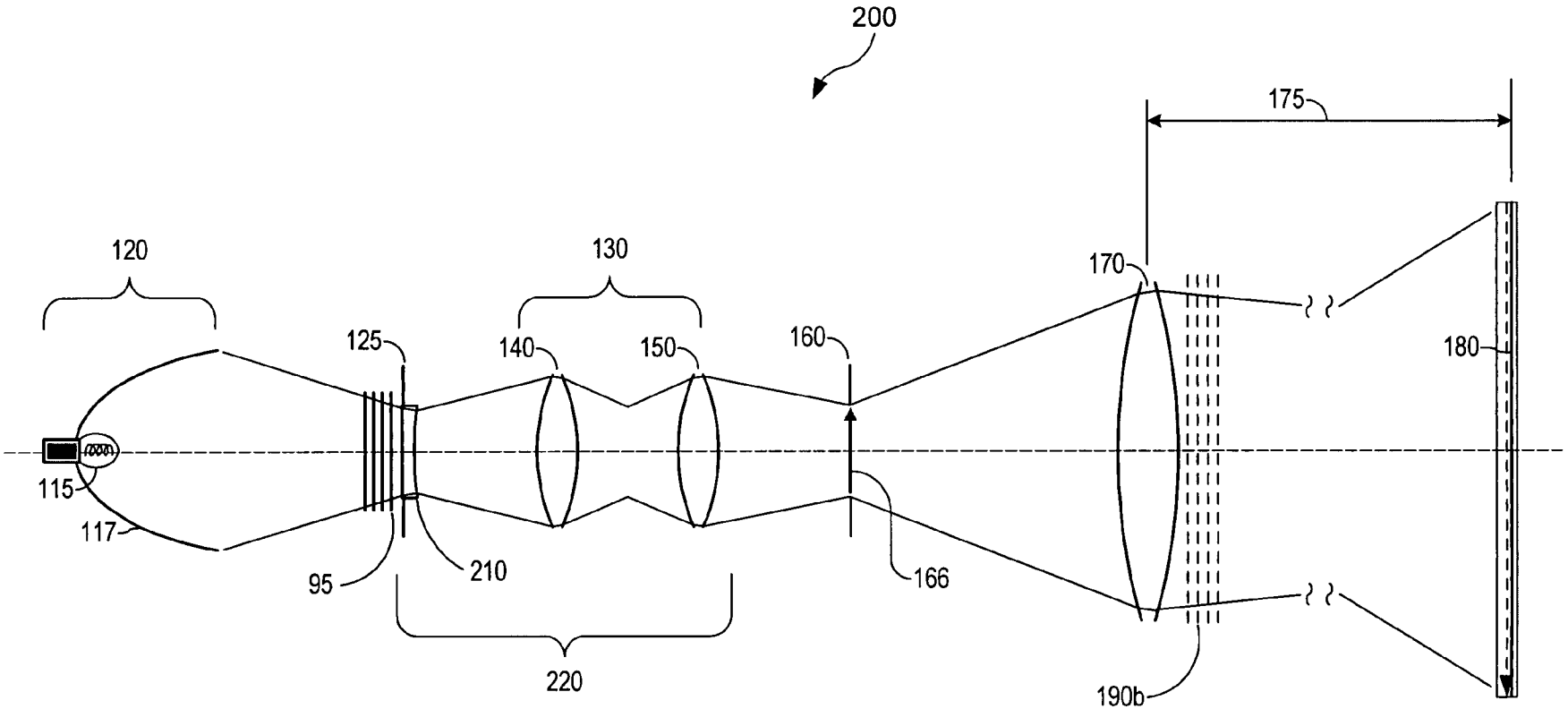
FIG. 8 is schematic diagram of a projection optical system including a patterned color and dimming apparatus and a relay lens system including a negative lens at the first field stop according to the present invention.

Referring now to FIG. 8, a spot luminaire projection optical system according to the present invention is generally indicated by the numeral 200. The optical system 200 includes a lamp 115 and a concave reflector 117. Together, the lamp 115 and the concave reflector 117 form the light source 120. The optical system 200 also includes a first field stop 125. A patterned color and dimming apparatus 95 is located in a volume contiguous to the first field stop 125. A positive relay lens group 130 is shown to include a first positive lens 140 and a second positive lens 150. The optical system 200 also includes a negative relay lens group 210. Together the positive relay lens group 130 and the negative relay lens group 210 comprise the relay lens group or overall relay lens group 220. The optical system 200 also includes a second field stop 160 which is coincident with the projection gate and a light pattern generator 166. The optical system 200 further includes a projection lens 170 which functions to project a beam of light across distance 175 to a distant projection surface 180.

As shown in FIG. 8, the addition of a weak negative lens 210 (negative relay lens group) serves to relocate the image 190*b* of the color and dimming system to a volume of space that is not imaged by the projection lens 170. It is therefore possible, through design, to force the image 190*b* of the patterned filter media 95 and the first field stop 125 to lie within or beyond the projection lens train, in a volume that is not imaged by the projection lens 170. In one embodiment, this will be accomplished by disposing image 190*b* away from the second field stop. In another embodiment, the image of the color and dimming system is disposed downstream of the second field stop. In another embodiment, the image is disposed downstream of the upstream surface of the projection lens. In another embodiment, the image of the color and dimming system projected by the relay lens group 210 is disposed downstream of the downstream surface of the projection lens 170, but not proximate the projection surface.

A properly designed relay lens system 220 allows the patterned filter media 95 to be placed near the first field stop 125 which is the smallest area in the beam of light, while ensuring that the images 190*b* of the patterned filter media 95 and first field stop 125 occupy a volume that is not re-imaged by the projection lens 170. The result is superior color mixing of the projected beam while minimizing the size of the patterned color filter material. It is believed that this type of relay lens color and dimming apparatus will provide uniform color mixing and high optical throughput.

Figure 9:
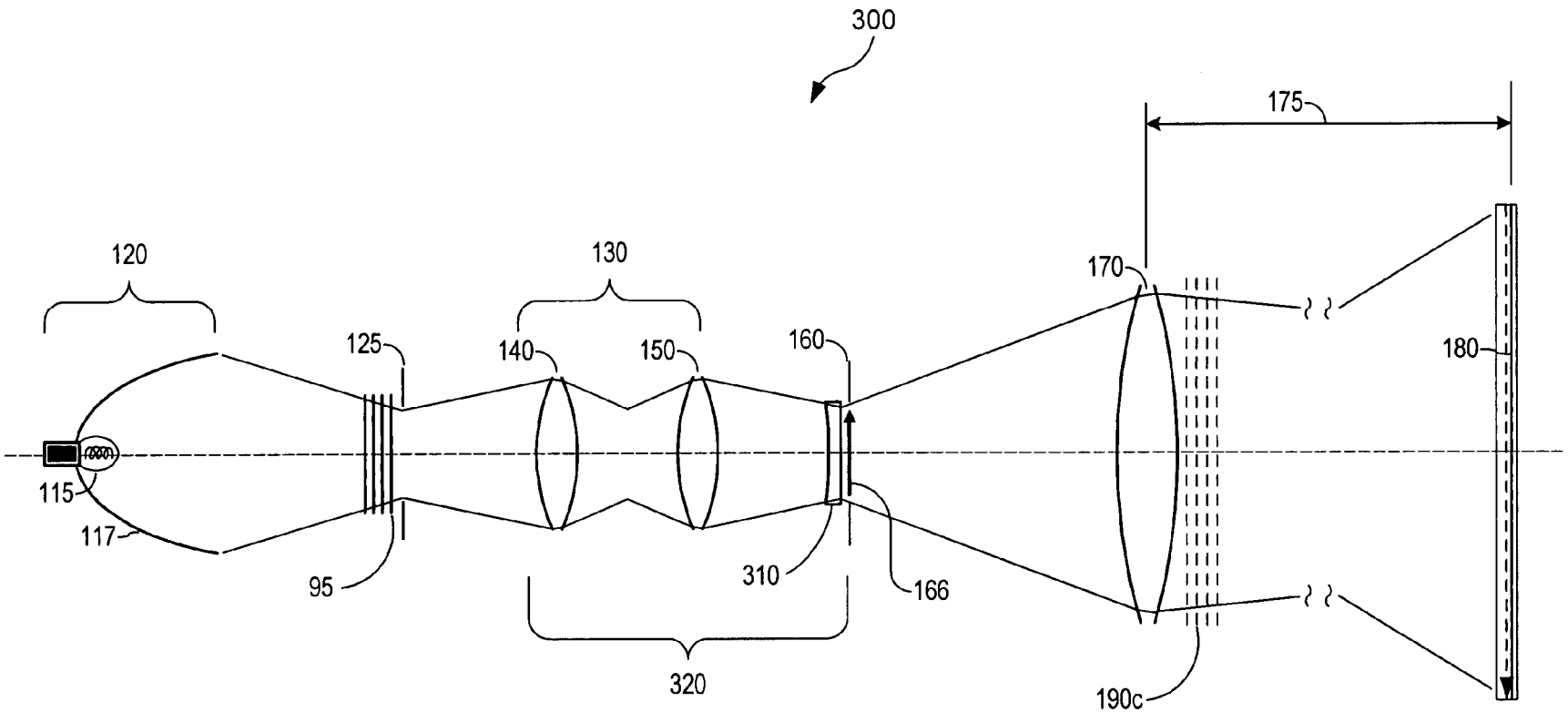
FIG. 9 is schematic diagram of a projection optical system including a patterned color and dimming apparatus and a relay lens system including a negative lens at the second field stop according to the present invention.

Referring now to FIG. 9, another spot luminaire projection optical system 300 according to the present invention is described. Here the basic structure of the spot luminaire projection optical system 300 is similar to the optical system 200 described above with reference to FIG. 8. However, in this example, the negative relay lens group 310 is positioned near the second field stop 160. Together the positive relay lens group 130 and the negative relay lens group 310 comprise the relay lens group or overall relay lens group 320. The addition of a weak negative lens 310 serves to relocate the image 190*c* of the color and dimming system 95 to a volume of space that is away from the second field stop and not imaged by the projection lens 170.

Figure 10:
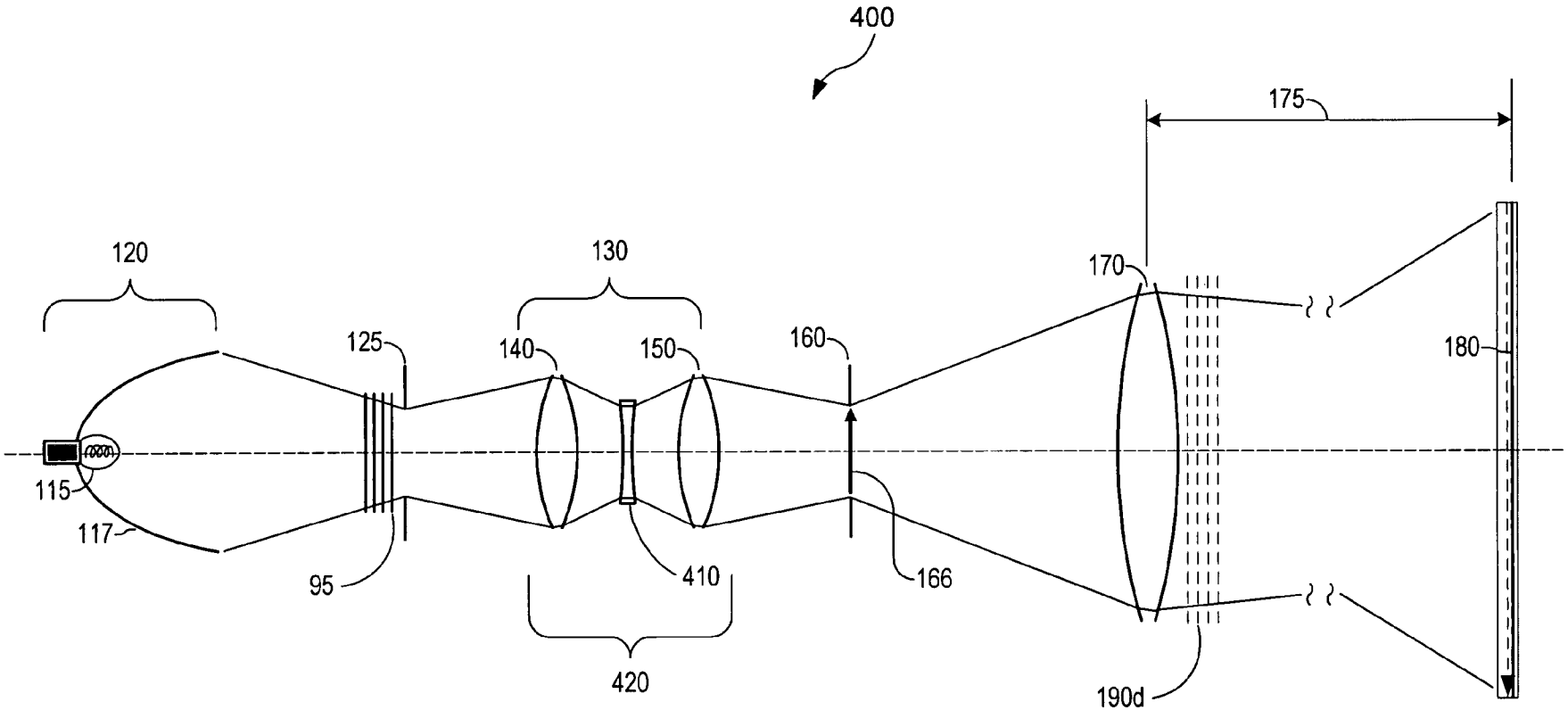
FIG. 10 is schematic diagram of a projection optical system including a patterned color and dimming apparatus and a relay lens system including a negative lens positioned within the relay lens according to the present invention.

Referring now to FIG. 10, yet another spot luminaire projection optical system 400 according to the present invention is shown. Here the basic structure of the spot luminaire projection optical system 400 is similar to the optical system 200 described above with reference to FIG. 8. However, in this example, the negative relay lens group 410 is positioned within the positive relay lens group 130 (between the first positive lens 140 and the second positive lens 150). Together the positive relay lens group 130 and the negative relay lens group 410 comprise the relay lens group 420. The addition of a weak negative lens 410 serves to relocate the image 190*d* of the color and dimming system 95 to a volume of space that is not imaged by the projection lens 170.

Figure 11:
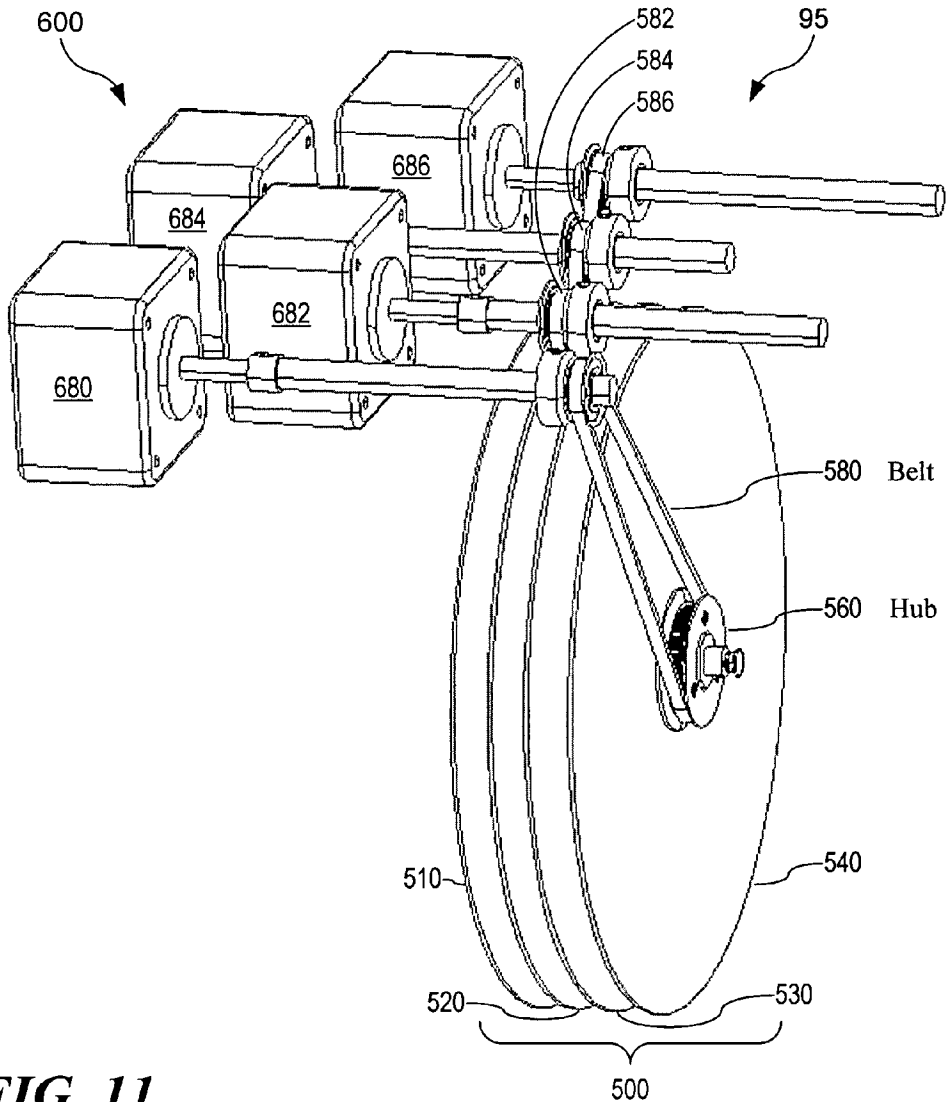
FIG. 11 is a pictorial representation of a motor driven color and dimming mechanism according to the present invention.
Figure 12:
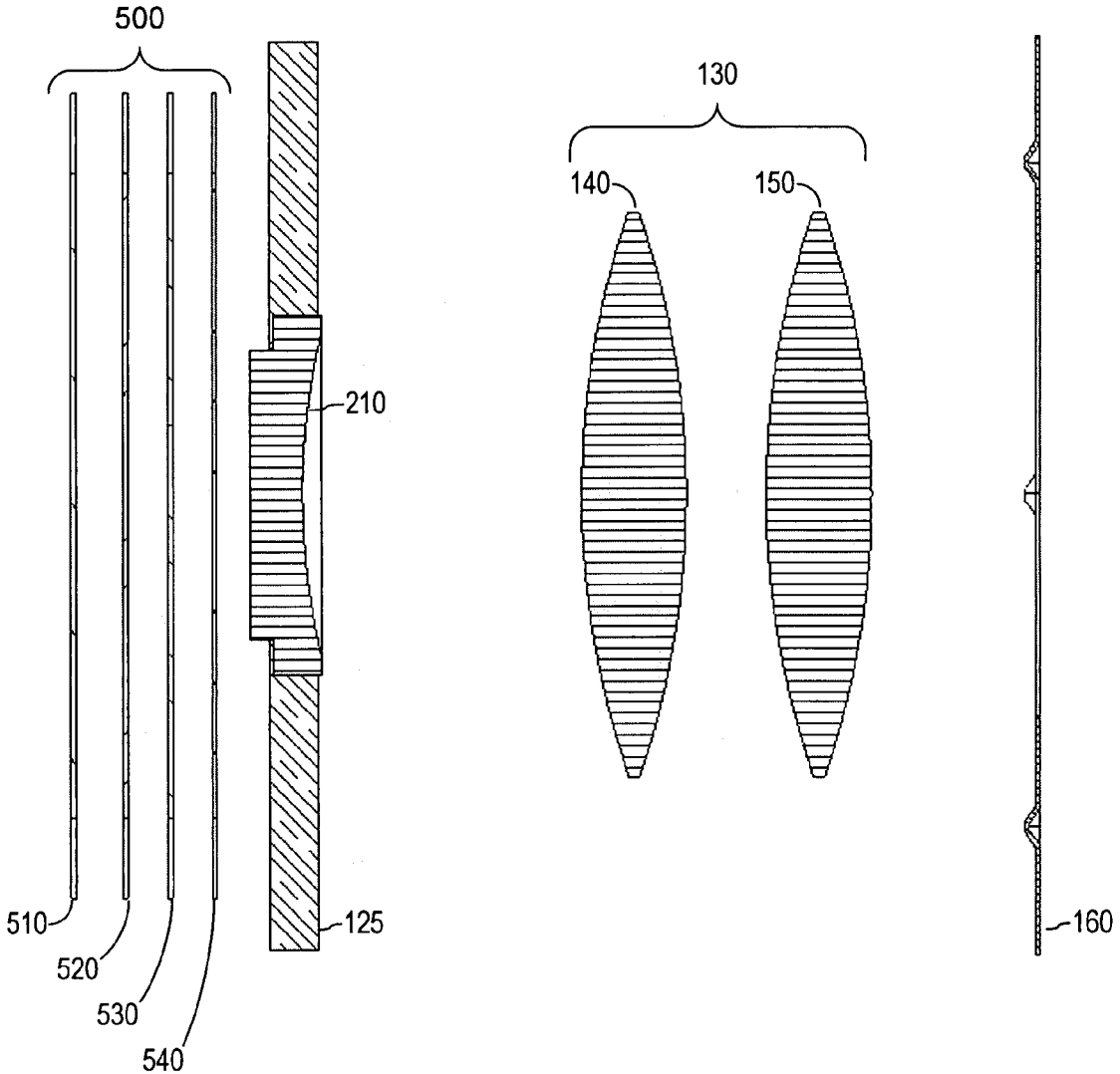
FIG. 12 is a pictorial representation of a relay lens color and dimming apparatus according to the present invention.

Referring now primarily to FIGS. 11 and 12, the filter apparatus 95 and other aspects of the invention are further described. As discussed previously, the filter apparatus 95 can be positioned proximate the first field stop 125. This placement of the filter apparatus 95 is shown in FIGS. 8–10 and 12. In these figures, one may also appreciate that the filter apparatus 95 can include a plurality of variable density filters.

In its basic form, the filter apparatus 95 can be adapted for selectively moving at least one variable density filter across the beam of light. However, as shown in FIGS. 11 and 12, the filter apparatus 95 can also be adapted for selectively moving or rotating a plurality of variable density filters 500 across the beam of light. These variable density filters 500 can be color filters and/or dimming filters. Therefore, movement can allow the operator to control the color and intensity (luminance) of the beam of light.

Referring now to FIG. 11, one implementation of the filter apparatus 95 is shown. In this example, the filter apparatus 95 is shown to include a series or stack of patterned wheels 500. Here the stack of patterned wheels 500 includes three color filter patterned wheels 510, 520 and 530. These correspond respectively to a cyan color wheel 510, a yellow color wheel 520, and a magenta color wheel 530. The remaining wheel is a dimming wheel 540. The filter apparatus 95 also includes a plurality of actuators or motors 600 which can be used for driving, moving, or causing rotation of the patterned wheels 500 in the beam of light.

Each of the wheels 500 includes a central hub. However, only the central hub 560 of the dimming wheel 540 is shown in the view provided by FIG. 11. The hub 560 of the dimming wheel 540 serves as a point of attachment for a drive belt 580. The drive belt 580 is also connected to one of the actuators 600. Here the drive belt 580 is connected to an actuator or motor 680 The hubs (not shown) of the remaining wheels (510, 520 and 530) are similarly coupled to drive belts 586, 584 and 582. These drive belts are in turn coupled to actuators or motors 686, 684 and 682. For example, when actuator 680 is activated, it will cause belt 580 to move, thereby causing rotation of the dimming wheel 540. The motors or actuators 600 can be mounted to a plate containing the first field stop 125. As each color filter 500 is rotated into the beam, it colors a portion of the rays passing through the first field stop 125. As the dimmer wheel 540 is rotated into the beam, it attenuates a portion of the rays passing through the first field stop 125 of the relay lens.

Thus, the patterned wheels 500 in the stack can be either color filters or dimming filters. One should appreciate that it is therefore possible to place a dimming filter, such as patterned wheel 540 at the first field stop location 125 (FIG. 12). The dimming filter works on the same principle as the color filters, except that it blocks the light rather than coloring it. Like the color filters, the dimmer can be located near the first field stop 125. Therefore, any pattern etched onto the dimmer 540 will not visible in the projected beam, and the dimmer 540 will merely control the amount of light present in the projected beam. It should be noted that, although patterned wheels 500 are depicted, the patterned media need not be in a wheel configuration. For example, the patterned media can be disposed on a sliding plate which can be used to slidably move to place the desired portion of the media into the light beam, rather than by rotating it, as with the wheel 500.

As described, the various color mixing systems or filter apparatus 95 can be positioned near the first field stop 125, which is located between the concave reflector 117 and the projection lens 170. The relay lens group (e.g., groups 220, 320 and 420) is designed so that a real image of the field stop 125 and color filter means 95 occupies a volume that is not re-imaged by the projection lens 170. These color filters can be composed of patterned color filter material deposited on substrates having any shape. As the filters 95 are moved into the path of the light beam, their edges are not visible and the projected image is evenly colored.

Regardless of the specific configuration of the filters and the dimmer, the projected image will have a fully blended homogeneous color. The actual shade and intensity of the image is dependent on the area of the field stop 125 covered by the unpatterned filter material. The principles of color filtering at a field stop are thus independent of any specific actuator means or specific filter shape.

Referring now to FIG. 12 which shows a relay lens color and dimming apparatus 95 according to the present invention. Patterned cyan, yellow, magenta, and dimmer wheels 510, 520, 530 and 540 are shown positioned before a first field stop plate 125. A weak negative lens 210 can be positioned in, and held by, the field stop plate aperture 125. A pair of lenses 140 and 150 comprises the positive lens relay group 130. A second field stop plate 160 is the same size, and in the same location, as the projection gate.

The color mixing system is well-suited for placement in the path of a high-intensity beam of light for illuminating a light pattern generator, gobo, or an image generator system. The color mixing system can also be used independently in any spot luminaire having a projection lens with a well defined projection gate.

Although specific embodiments of the present invention are disclosed, these are not to be construed as limiting the scope of the present invention. Many variants of the invention will become apparent to those skilled in the art in light of this specification. The scope of the invention is only limited by the claims appended hereto.

What is claimed is:

1. A spot luminaire comprising:

a light source projecting a beam of light;

a projection lens configured to project the beam of light towards a distant projection surface;

a first field stop positioned between the light source and the projection lens, and through which the beam of light passes;

a filter apparatus positioned proximate the first field stop and adapted for selectively moving at least one variable density filter across the beam of light; and a relay lens group positioned between the first field stop and the projection lens, wherein the relay lens group is configured to prevent the at least one variable density filter from being imaged by the projection lens onto the projection surface.

2. The spot luminaire of claim 1, wherein the filter apparatus includes at least one actuator adapted for selectively moving at least one variable density filter across the beam of light.

3. The spot luminaire of claim 1, wherein the at least one variable density filter is a colored filter.

4. The spot luminaire of claim 1, wherein the at least one variable density filter is a dimming filter.

5. The spot luminaire of claim 1, wherein the filter apparatus is adapted for selectively moving at least three variable density color filters.

6. The spot luminaire of claim 1, wherein the at least one variable density filter is movable into and out of a position proximate the first field stop.

7. The spot luminaire of claim 1, wherein the at least one variable density filter is a patterned color wheel configured for rotation across the path of the beam of light.

8. The spot luminaire of claim 1, wherein the image of the filter apparatus formed by the relay lens group is disposed away from a second field stop, the second field stop being located between the relay lens group and the projection lens.

9. The spot luminaire of claim 8, wherein the image of the filter apparatus formed by the relay lens group is disposed to a volume of space that is not imaged by the projection lens.

10. The spot luminaire of claim 9, wherein the image of the filter apparatus formed by the relay lens group is disposed downstream of the second field stop but not proximate the projection surface.

11. The spot luminaire of claim 10, wherein the image of the filter apparatus formed by the relay lens group is disposed downstream of the upstream surface of the projection lens but not proximate the projection surface.

12. The spot luminaire of claim 1, wherein the relay lens group includes a first lens group with negative optical power, a second lens group with positive optical power and a second field stop, the image of the filter apparatus formed by the relay lens group being disposed away from the second field stop.

13. The spot luminaire of claim 12, wherein the first lens group with negative optical power is located at or near the first field stop and the second lens group with positive optical power is located between the first field stop and the second field stop.

14. The spot luminaire of claim 12, wherein the second lens group comprises two spaced apart positive lens groups, the first lens group with negative optical power being located between the two spaced apart positive lens groups and between the first field stop and the second field stop.

15. The spot luminaire of claim 12, wherein the first lens group with negative optical power is located at or near the second field stop and the second lens group with positive optical power is located between the first field stop and the first lens group.

16. The spot luminaire of claim 12, wherein the negative first lens group is weak relative to the positive second lens group.

17. A spot luminaire comprising:

a light source for emitting a beam of light;

a projection lens configured to project the beam of light towards a distant projection surface;

a first field stop positioned to receive the beam of light from the light source;

a filter apparatus positioned proximate the first field stop and adapted for selectively moving a plurality of variable density filters across the beam of light thereby controlling the color and intensity of the beam of light; and a relay lens group located between the first field stop and the projection lens, wherein in operation the relay lens group directs the beam of light from the first field stop to the projection lens and positions an image of the filter apparatus to a volume of space that is not imaged by the projection lens onto the projection surface.

18. The spot luminaire of claim 17, wherein the filter apparatus includes at least one actuator adapted for selectively rotating the plurality of variable density filters in the beam of light.

19. The spot luminaire of claim 17, wherein the filter apparatus includes a plurality of actuators adapted for selectively rotating the plurality of variable density filters in the beam of light.

20. The spot luminaire of claim 17, wherein the plurality of variable density filters includes at least one colored filter.

21. The spot luminaire of claim 17, wherein the plurality of variable density filters includes at least three complementary color filters.

22. The spot luminaire of claim 17, wherein the plurality of variable density filters includes at least one dimming filter.

23. A method for providing lighting, comprising:

providing a light source for emitting a beam of light;

providing a first field stop positioned to receive the beam of light from the light source;

providing a projection lens configured to project the beam of light towards a distant projection surface;

moving a variable density color filter into the beam of light proximate the first field stop to achieve a desired color density; and providing a relay lens group positioned between the first field stop and the projection lens, wherein the relay lens group is configured to locate the image of the variable density color filter to a volume of space that is not imaged by the projection lens onto the projection surface.

24. The method of claim 23, and further comprising:

rotating a variable density dimming filter into the beam of light proximate the first field stop to achieve a desired light intensity.

25. The method of claim 23, and further comprising:

rotating a variable density color filter into the beam of light proximate the first field stop to achieve a desired light intensity.

26. A spot luminaire comprising:

a light source for emitting a beam of light;

a first field stop positioned to receive the beam of light from the light source;

a filter apparatus positioned proximate the first field stop and adapted for selectively moving a plurality of variable density filters in the beam of light thereby controlling the color and intensity of the beam of light;

a projection lens configured to project the beam of light towards a distant target;

a relay lens group located between the first field stop and the projection lens, wherein in operation the relay lens group directs the beam of light from the first field stop to the projection lens and positions an image of the filter apparatus so that the image of the filter apparatus is located in a volume of space that is not imaged by the projection lens onto a projection surface; and a second field stop positioned between the relay lens group and the projection lens.

27. The spot luminaire of claim 26, wherein the second field stop is coincident with a projection gate.

28. The spot luminaire of claim 27, and further comprising a light pattern generator positioned at the second field stop.

* * * * *